US006588451B2

(12) United States Patent
Kuroshita et al.

(10) Patent No.: US 6,588,451 B2
(45) Date of Patent: Jul. 8, 2003

(54) HOLDING STRUCTURE FOR HOLDING DEVICE ON FUEL TANK

(75) Inventors: Kazuhisa Kuroshita, Kako-gun (JP); Yukio Asakura, Akashi (JP); Atsufumi Ozaki, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 168 days.

(21) Appl. No.: 09/798,987

(22) Filed: Mar. 6, 2001

(65) Prior Publication Data

US 2001/0042567 A1 Nov. 22, 2001

(30) Foreign Application Priority Data

Mar. 8, 2000 (JP) ..... 2000-062957

(51) Int. Cl.[7] ..... F17C 13/00
(52) U.S. Cl. ..... 137/565.17; 137/590
(58) Field of Search ..... 137/565.17, 590

(56) References Cited

U.S. PATENT DOCUMENTS 2,956,586 A * 10/1960 Zeigler et al. ..... 137/590
4,304,530 A * 12/1981 Gens ..... 137/565.01
6,302,144 B1 * 10/2001 Graham et al. ..... 137/565.17

FOREIGN PATENT DOCUMENTS

JP 62-497 U 1/1987

* cited by examiner

*Primary Examiner*—Gerald A. Michalsky
(74) *Attorney, Agent, or Firm*—Oliff & Berridge, PLC

(57) ABSTRACT

A holding structure for holding a device on a fuel tank can be manufactured by small man-hours, and is simple in construction and excellent in vibration isolating performance. The holding structure holds a device (11) inserted in a fuel tank (10) on the fuel tank (10). The holding structure includes a holding tube (19) formed integrally with the fuel tank (10) so as to surround an opening (18) formed in the fuel tank (10), an elastic boot (21) put on the holding tube (19) so as to be in close contact with the outer circumference **(19*a*) of the holding tube (19) and the outer circumference (15*a*) of a part of the device (11), extending outside from the holding tube (19), and a fastening device (22, 23) for fastening the elastic boot (21) to the respective outer circumferences (19*a*, 15*a*) of the holding tube (19) and the device (11)**.

5 Claims, 5 Drawing Sheets

HOLDING STRUCTURE FOR HOLDING DEVICE ON FUEL TANK

BACKGROUND OF THE INVENTION

1. Field of the Invention

The present invention relates to a holding structure for holding a device, such as a fuel pump, on a fuel tank mounted on a water craft or a vehicle.

2. Description of the Related Art

A fuel tank mounted on, for example, a water craft is formed of a resin in recent years with a view to forming the fuel tank in a lightweight structure and facilitating work for mounting the fuel tank on the water craft. FIG. 5 shows a conventional holding structure for holding a fuel pump on a fuel tank of a resin. When forming a fuel tank 30, a reinforcing metal ring 39 is embedded in the brim of a pump receiving hole 38 formed in the fuel tank 30 by an insert molding method. A flange 32 welded to the outer circumference of a fuel pump 31 is fastened to the brim of the pump receiving hole 38 with screws 40 screwed in internal thread of the metal ring 39. A rubber sealing ring 41 is placed between the flange 32 and the brim of the pump receiving hole 38. A prior art holding structure for holding a device on a tank is disclosed in, for example, JP-U No. Sho 62-497.

This holding structure, however, is complicated and increases steps of a molding process for forming the fuel tank 30 because the metal ring 39 must be embedded in the brim of the pump receiving hole 38. Consequently, the holding structure is costly. Since the holding structure is rigid, vibrations generated by an engine and transmitted through the hull of the water craft to the fuel tank are transmitted easily to the fuel pump 31.

SUMMARY OF THE INVENTION

The present invention has been made in view of the aforesaid problems and it is therefore an object of the present invention to provide a holding structure for holding a device on a fuel tank, capable of being fabricated by small man-hours, having simple construction and excellent in vibration isolating performance.

To achieve the object, the present invention provides a holding structure for holding a device inserted in a fuel tank on the fuel tank of a resin, comprises: a holding tube formed integrally with the fuel tank so as to surround an opening formed in the fuel tank; an elastic boot put on the holding tube so as to be in close contact with the outer circumference of the holding tube and the outer circumference of a part of the device inserted through the opening in the fuel tank, extending outside from the holding tube; and a fastening device for fastening the elastic boot to the respective outer circumferences of the holding tube and the device.

The holding structure of the present invention does not increase man-hours necessary for forming the fuel tank, is simple in construction and can be manufactured at a low cost. Since the elastic boot holds the device on the fuel tank, the vibrations of the fuel tank are absorbed and damped by the elastic boot and are propagated hardly to the fuel pump.

Preferably, a main case of the device is provided with a flange, a cap closing one end of the main case is provided with a flange, the flanges are joined together to connect the main case and the cap, and the flange of the main case rests on the end surface of the holding tube. Thus, the holding structure facilitate correctly locating the device on the fuel tank.

DESCRIPTION OF THE PREFERRED EMBODIMENTS

A preferred embodiment of the present invention will be described hereinafter with reference to the accompanying drawings.

Figure 1:
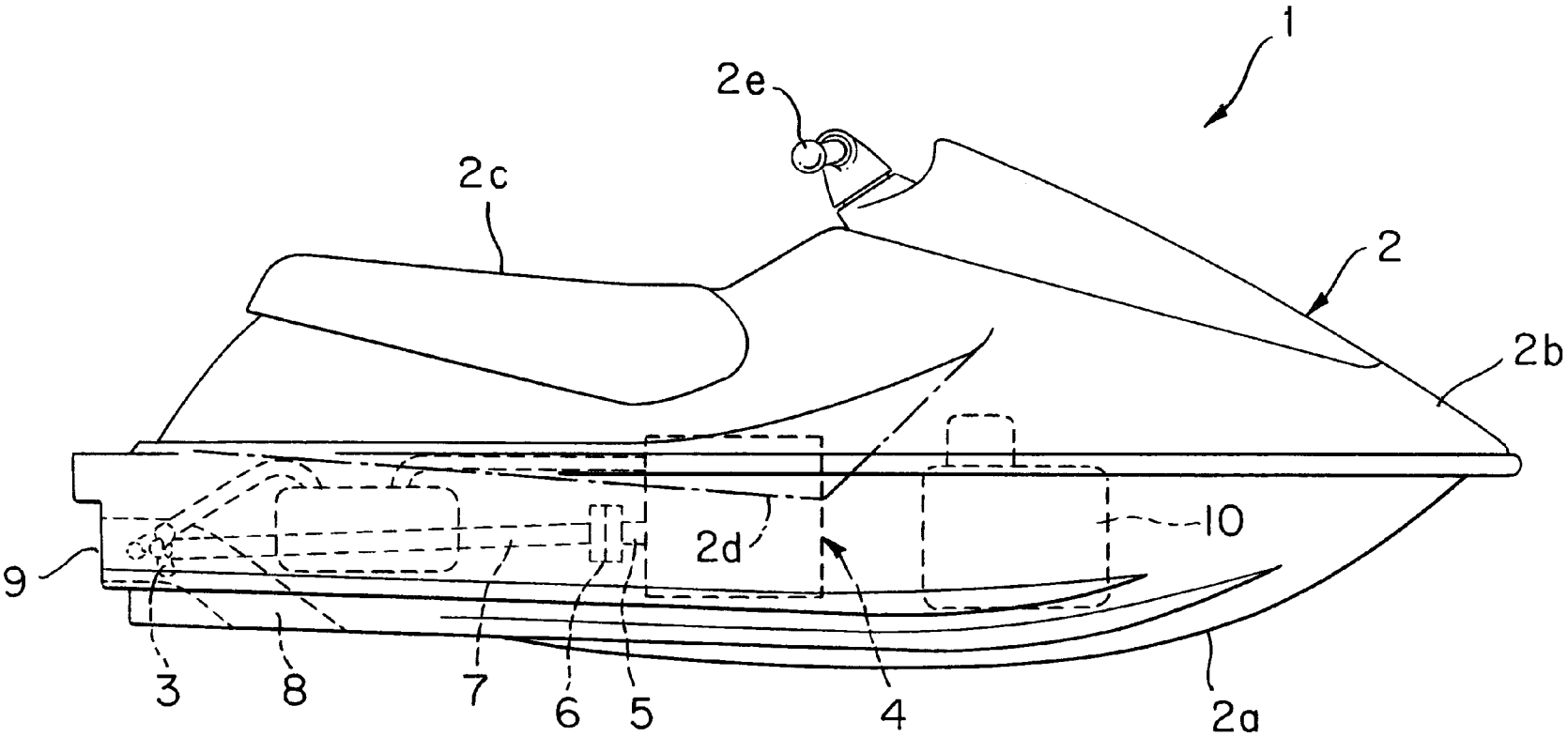
FIG. 1 is a side elevation of a personal water craft mounted with a fuel tank employing a holding structure in a preferred embodiment according to the present invention.

Referring to FIG. 1 showing a personal water craft 1 mounted with a fuel tank 10 employing a holding structure in a preferred embodiment according to the present invention, the personal water craft 1 has a body 2 formed by joining a deck 2*b* to a hull 2*a*. A seat 2*c* and steps 2*d* are formed on the deck 2*b*. The personal water craft 1 is provided with a handlebar 2*e*. A water jet propulsion unit 3 is mounted on the bottom wall of the hull 2*a* in the stern of the hull 2*a*. An engine 4 is installed in the hull 2*a*. The engine 4 has a shaft 5 connected to a shaft 7 of the propulsion unit 3 by a coupling 6. The engine 4 drives the propulsion unit 3 to suck water through a duct 8 placed on the bottom and to jet the water through a nozzle 9 for jet propulsion. The fuel tank 10 is disposed in a space in front of the engine 4 in the hull 2*a* and is attached to the hull 2*a*.

Figure 4:
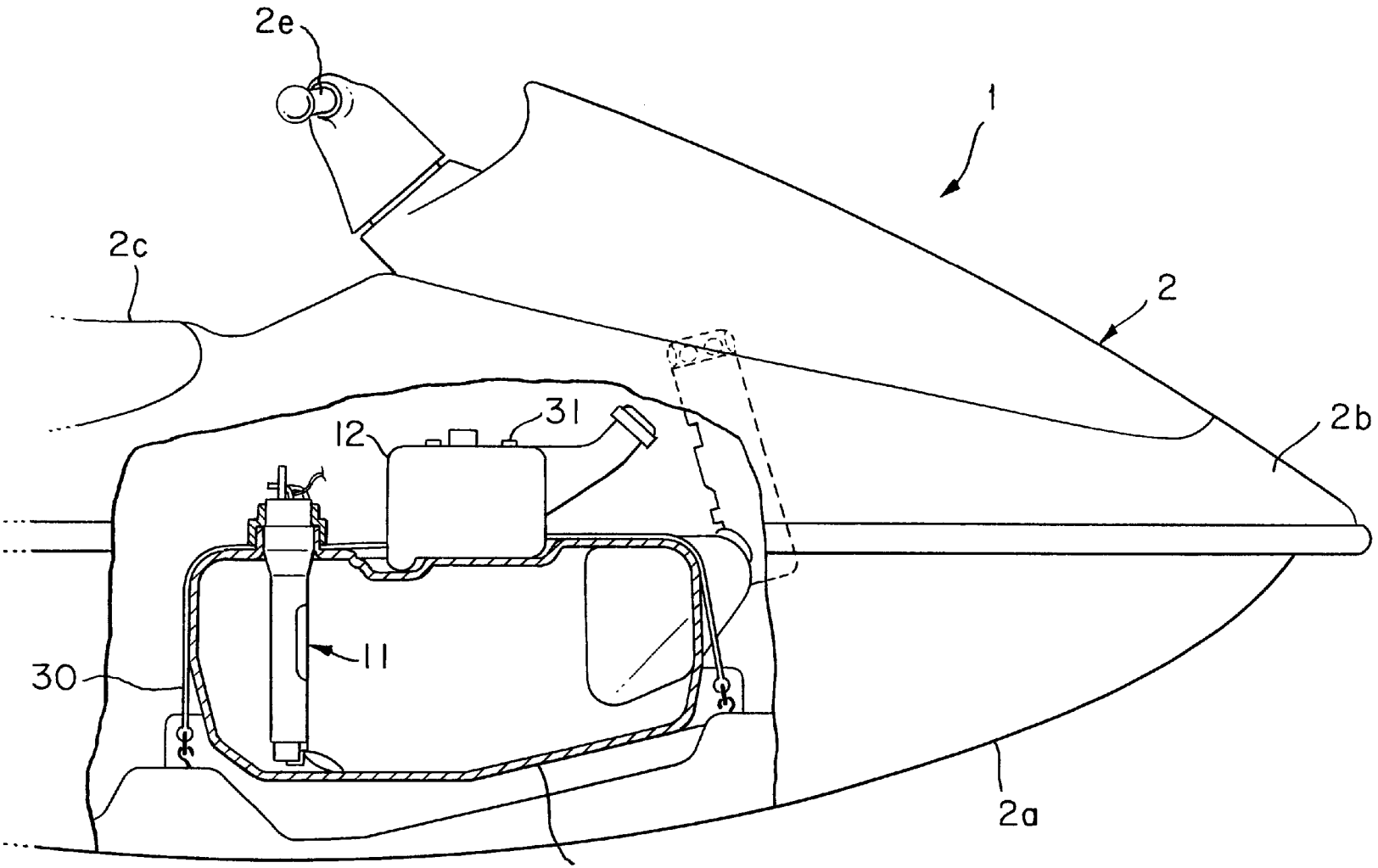
FIG. 4 is a partly cutaway side elevation of the runabout shown in FIG. 1 mounted with the fuel tank employing the holding structure in the preferred embodiment.
Figure 5:
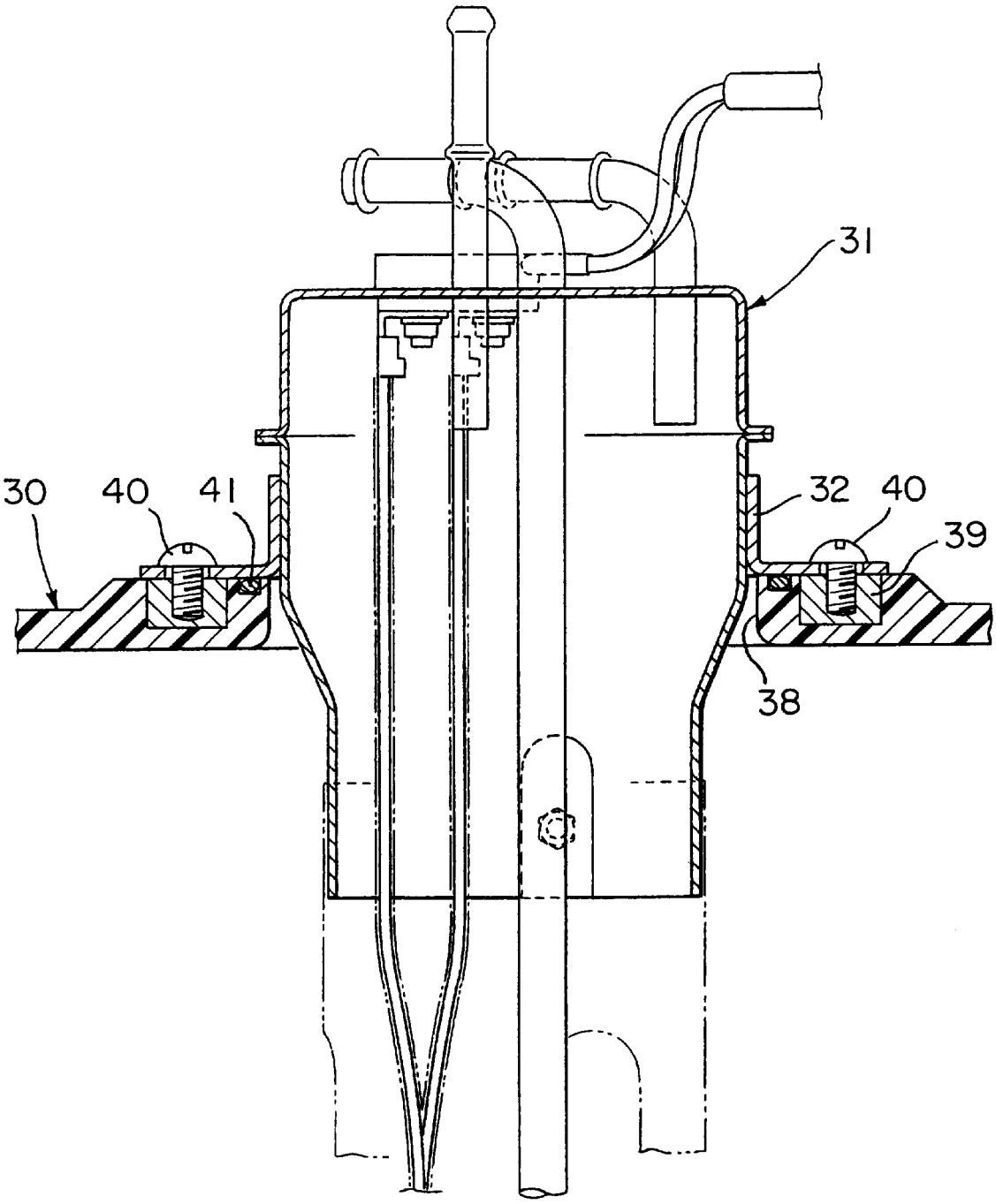
FIG. 5 RELATED ART
FIG. 5 is a longitudinal sectional view of a conventional holding structure.

FIG. 4 shows the fuel tank fastened to the body 2 by fastening means 30, such as rubber bands. The fuel tank 10 is made of a resin. A fuel pump 11 and devices including a fuel gage, not shown, are attached to the fuel tank 10. The fuel pump 11 pumps fuel to fuel injection valves, not shown, included in the engine 4. An oil tank 12 is placed on and fastened by a fastening means 31, such as rubber bands, to the fuel tank 10.

Figure 2:
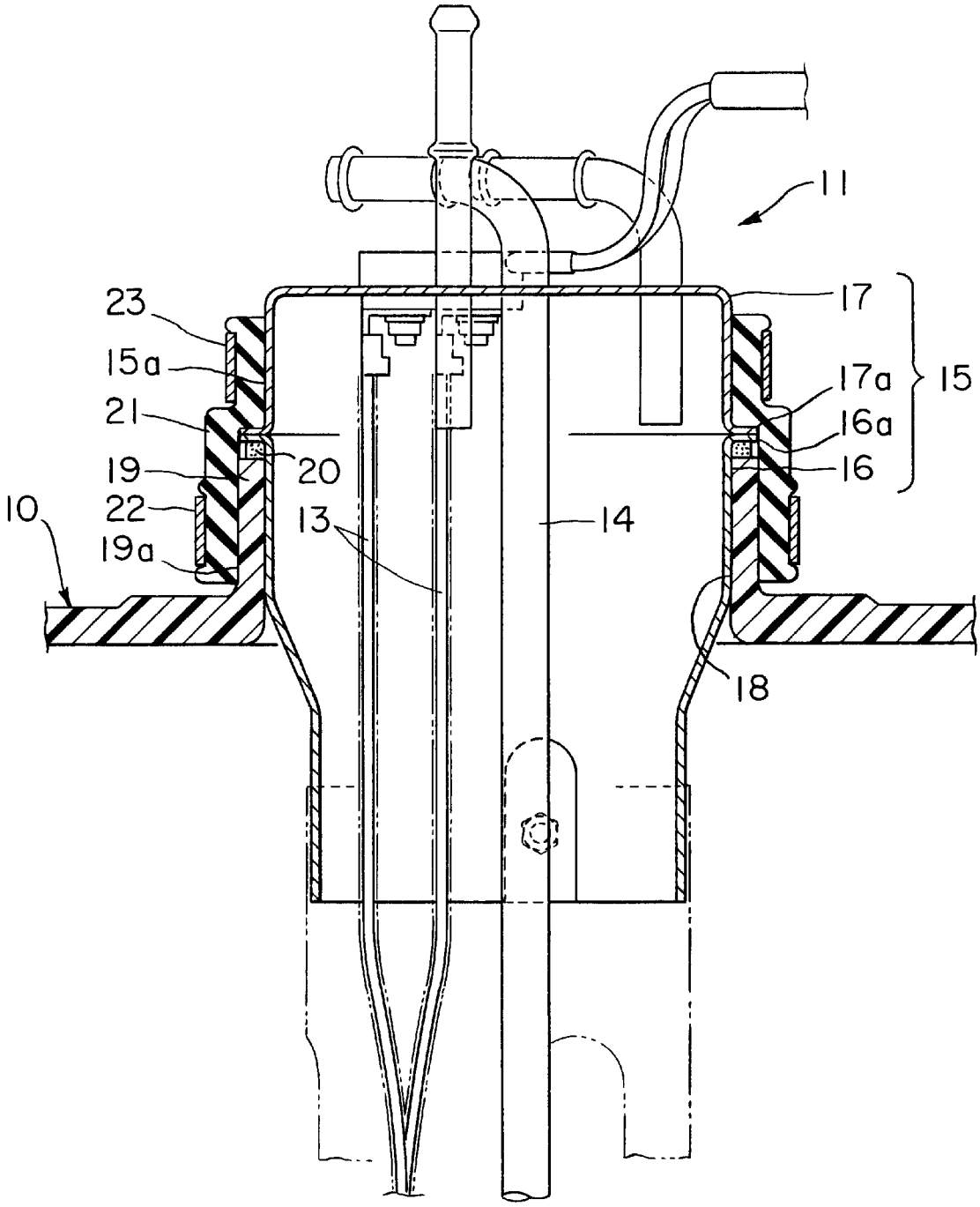
FIG. 2 is a longitudinal sectional view of the holding structure in the embodiment.
Figure 3:
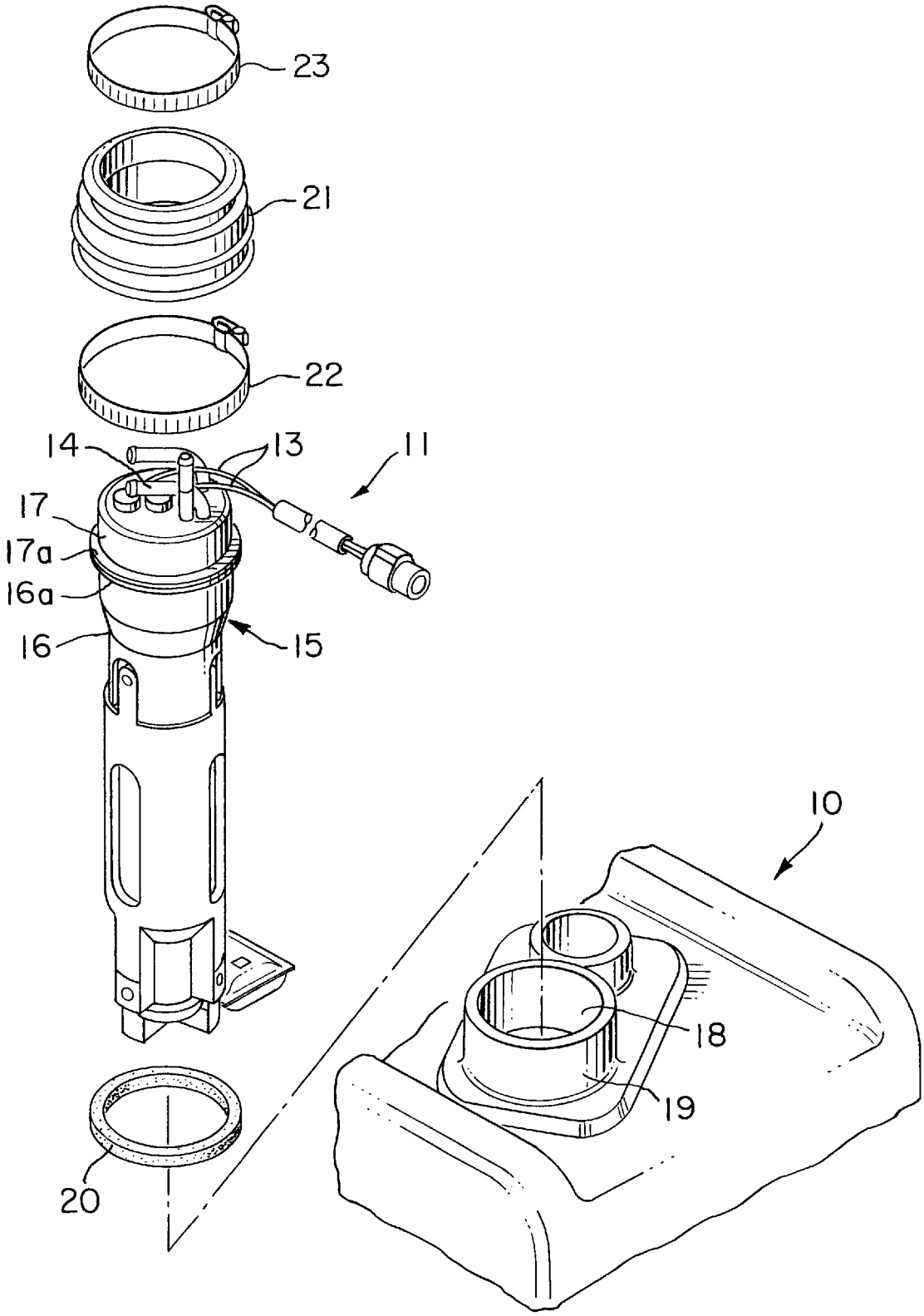
FIG. 3 is an exploded perspective view of the holding structure shown in FIG. 2.

FIG. 2 is a sectional view of a holding structure for holding the fuel pump 11 on the fuel tank 10 and FIG. 3 is an exploded perspective view of the holding structure shown in FIG. 2. The fuel pump 11 has a pump unit, not shown, cables 13 connecting the pump unit to a power supply, a pumping pipe 14 connected to the pump unit, and a pump case 15 containing those components. The pump case 15 is formed by joining together a case body 16 and a cap 17. The cap 17 closes the open upper end of the case body 16. The case body 16 is provided with a flange 16*a* at its upper end, the cap 17 is provided with a flange 17*a* at its lower end, and the flanges 16*a* and 17*a* are joined together by, for example, welding to join the case body 16 and the cap 16 together.

An opening 18 is formed in the upper wall of the fuel tank 10. The fuel pump 11 is inserted through the opening 18 in the fuel tank 10. A holding tube 19 is formed integrally with the upper wall of the fuel tank 10 so as to surround the opening 18. The fuel pump 11 is inserted through the opening 18 in the fuel tank 10 with the flange 17*a* thereof resting on the free end of the holding tube 19. An annular gasket 20 made of an elastic material, such as rubber, is held between the flange 17*a* and the free end of the holding tube 19.

An elastic boot 21 made of an elastic material, such as rubber, is put on the holding tube 18 so as to be in close contact with the outer circumference 19*a* of the holding tube 19 and the outer circumference 15*a* of a part of the pump case 15 inserted through the opening 18 in the fuel tank 10, extending outside from the holding tube 19. Thus the elastic boot 21 is a single member and extends continuously over the outer circumference 19*a* of the holding tube 19 and the outer circumference 15*a* of the pump body 15. The elastic boot 21 is fastened to the outer circumference 19*a* of the holding tube 19 and the outer circumference 15*a* of the pump case 15 by clamps 22 and 23, such as hose clamps. In this embodiment, the working diameter of the clamp 22 fastening the boot 21 to the outer circumference 19*a* the holding tube 19 is greater than that of the clamp 23 fastening the boot 21 to the outer circumference 15*a* of the pump case 15. The working diameter of the clamp 22 may be equal to or smaller than that of the clamp 23.

The holding structure for holding the fuel pump 11 on the fuel tank 10 does not need any metal member embedded in the fuel tank 10. Therefore the holding structure reduces man-hours necessary for forming the fuel tank 10, has simple construction and can be manufactured at a low cost. Since the fuel pump 11 is held on the holding tube 19 of the fuel tank 10 by the elastic boot 21, the joint of the fuel pump 11 and the holding tube 19 can be sealed and vibrations of the fuel tank 10 that may be transmitted to the fuel pump 11 can be attenuated by the vibration isolating effect of the elastic boot 21. The fuel pump 11 can be easily positioned on the fuel tank 10 simply by inserting the case body 16 through the opening 18 in the fuel tank 10 so that the flange 16*a* of the case body 16 rests on the free end of the holding tube 19 with the annular gasket 20 of rubber or the like held between the flange 16*a* and the free end of the holding tube 19. The annular gasket 20 enhances the vibration isolating performance of the holding structure.

Although the holding structure in this embodiment has been described as applied to holding the fuel pump 11 on the fuel tank 10, a holding structure similar to the aforesaid holding structure can be used for holding other device, such as a filter device including a filter and a main/reserve tank selector valve or a fuel gage, on the fuel tank 10. A holding structure according to the present invention is applicable to holding a device on the fuel tank of a vehicle, such as a motorcycle.

As apparent from the foregoing description, according to the present invention, the holding structure for holding a device inserted in a fuel tank on the fuel tank of a resin comprises the holding tube formed integrally with the fuel tank so as to surround the opening formed in the fuel tank the elastic boot put on the holding tube so as to be in close contact with the outer circumference of the holding tube and the outer circumference of a part of the device inserted through the opening in the fuel tank, extending outside from the holding tube, and the clamps for fastening the elastic boot to the respective outer circumferences of the holding tube and the device. Thus, the holding structure needs small man-hour for making the same and is simple in construction. The elastic boot holding the device on the fuel tank isolates the device from the vibrations of the fuel tank.

Although the invention has been described in its preferred embodiment, the present invention is not limited thereto in its practical application and many changes and variations may be made without departing from the scope and spirit thereof.

What is claimed is:

1. A holding structure for holding a device inserted in a fuel tank made of a resin on the fuel tank, comprising:

a holding tube formed integrally with the fuel tank so as to surround an opening formed in the fuel tank;

an elastic boot put on the holding tube so as to be in close contact with an outer circumference of the holding tube and an outer circumference of a part of the device inserted through the opening in the fuel tank, extending outside from the holding tube; and a fastening device for fastening the elastic boot to the respective outer circumferences of the holding tube and the device, wherein a main case of the device is provided with a flange, a cap closing one end of the main case is provided with a flange, the flanges are joined together to connect the main case and the cap, and the flange of the main case rests on an end surface of the holding tube.

2. The holding structure according to claim 1, wherein the device is a fuel pump.

3. The holding structure according to claim 1, wherein the fastening device includes a first clamp that fastens elastic boot to the outer circumference of the holding tube, and a second clamp that fastens the elastic boot to the outer circumference of the device.

4. The holding structure according to claim 3, wherein the first clamp has a working diameter greater than that of the second clamp.

5. The holding structure according to claim 1, wherein the elastic boot is a single member and extends continuously over the outer circumference of the holding tube and the outer circumference of the part of the device, extending outside from the holding tube.

* * * * *